US006682352B2

(12) United States Patent
Lopez

(10) Patent No.: US 6,682,352 B2
(45) Date of Patent: Jan. 27, 2004

(54) FOLDING WRITING BOARD

(76) Inventor: Oscar Lopez, 410 E. 229th Pl., Carson, CA (US) 90745

( * ) Notice: Subject to any disclaimer, the term of this patent is extended or adjusted under 35 U.S.C. 154(b) by 0 days.

(21) Appl. No.: 10/076,697

(22) Filed: Feb. 13, 2002

(65) Prior Publication Data

US 2003/0152908 A1 Aug. 14, 2003

(51) Int. Cl.[7] ..... B43L 1/10
(52) U.S. Cl. ..... 434/408; 434/415; 434/420
(58) Field of Search ..... 434/408, 415, 434/419, 420, 417; 281/16, 49

(56) References Cited

U.S. PATENT DOCUMENTS 370,349 A * 9/1887 Pershing ..... 281/16
464,417 A * 12/1891 Bevin ..... 283/37
2,272,086 A * 2/1942 Harris ..... 281/16
3,435,542 A * 4/1969 Barouh ..... 434/157
3,479,752 A * 11/1969 Criger ..... 434/365
3,758,136 A * 9/1973 Guyer ..... 281/16
4,486,032 A * 12/1984 Leahy ..... 281/46
5,938,449 A * 8/1999 Masson et al. ..... 434/415

* cited by examiner

*Primary Examiner*—Kien T. Nguyen
(74) *Attorney, Agent, or Firm*—Clifford Kraft

(57) ABSTRACT

A foldable writing board made up of at least four panels attached by hinges or other attachment means so that the board can be folded out flat to become a full size writing board, folded in two to become either a taller or shorter noteboard (folded in a tent-like configuration) or folded in four to either store flat or to be set up as a small computer notepad. The panels are held together by three or more foldable attachment means that hold the panels together, but allow them to also fold along adjacent edges.

20 Claims, 8 Drawing Sheets

FOLDING WRITING BOARD

BACKGROUND

1. Field of the Invention

The present invention relates generally to the field of writing boards and more particularly to a folding writing board that is portable and can be set up different ways.

2. Description of Related Art

Whiteboards and blackboards are known in the art. Usually these are fairly large flat boards that are hung on walls. The problem with such boards is that they are generally fixed and not portable. The need for a portable writing board arises when one wants a writing surface in a place where there is none.

It is known in the art to supply writing pens with whiteboards. Prior art boards sometimes have a tray on their lower side to hold such pens. However, many times a whiteboard can be found in a conference room or similar place with no pens. In this case, the board is almost useless.

In the art of portable games, it is known to make a folding playing surfaces. However, these surfaces are usually for playing and cannot be written on.

What is badly needed is a portable, folding writing board that optionally has a pen attached. Such a board could be unfolded to various sizes for different applications.

SUMMARY OF THE INVENTION

The present invention relates to a unique writing board that folds in order to be portable and to set up in different configurations. While the preferred embodiment of the present invention is a whiteboard that folds in four sections, any type of writing board and any number of folded sections are within the scope of the invention.

The preferred embodiment of the invention comprises a generally rectangular board with a smooth top surface of the type used to make whiteboards. The sized of the board can be around 22 inches by 17 inches or any other convenient size. The larger rectangular board is cut into four or more smaller rectangles which are held together by a set of attachment means on the back side. The attachment means can be hinges, tape, or any other means for holding panels together. The exact shape of the hinges is not important to the functioning of the invention and can be of various lengths and widths. The hinges or attachment means can be made of various materials from simple tape to metal or plastic. Any type of hinge that can hold two flat sheets together while allowing them to fold together is within the scope of the invention. The preferred length for one of the hinges is around 3 inches, but much longer hinges can be used.

It is possible to place three hinges or attachment means such as tape in such a positions that when the board is folded in four, the three hinges do not touch each other. This is done by placing the hinges in the following positions on the back of the board when the board is laid open flat: the first hinge is placed on the horizontal centerline about one inch from the right edge; the second hinge is placed on the horizontal centerline about one inch from the vertical centerline; the third hinge is placed on the vertical centerline about one to two inches from the top.

The board can be folded in two or in four. When it is folded in four, it forms a flat stack that is very compact and portable. When it is folded in two, it can be placed upright in one of two positions to form a partially vertical writing surface (supported like a tent). If the overall shape of the board is rectangular, folding the board in two in the two possible configurations forms a writing surface of two different heights. This is convenient for different writing situations and requirements.

When the invention is folded in four, it is also possible to form a tent-like partially vertical writing surface. This is ideal for situations where a large board is not required (for example as a notepad for a computer).

An optional pen with eraser can be attached to one edge of the folded up board (folded in four) for carrying. This provides a means of always having a pen when the board is needed for writing.

It should be understood that the figures provided are for illustration only. Many other configurations not shown in the figures are possible for the present invention.

DETAILED DESCRIPTION

Figure 1:
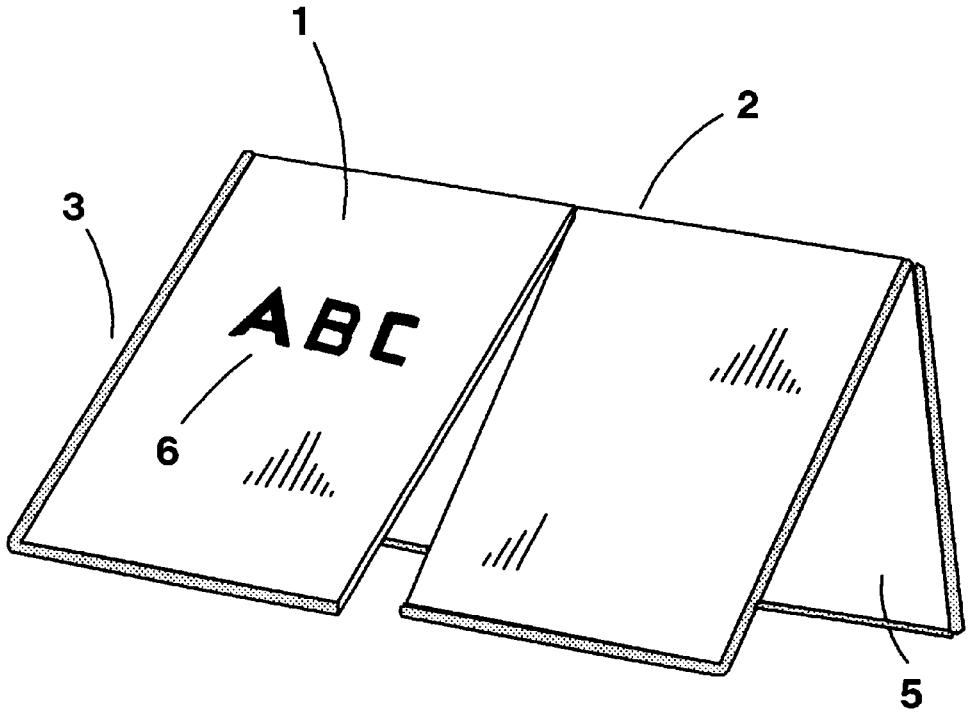
FIG. 1 shows a folded in two configuration of the preferred embodiment.

FIG. 1 shows the present invention, a four section portable writing surface folded in two and propped upright in the fashion of a tent. The outer surface 1 is a smooth writing surface. In the preferred embodiment, the writing surface 1 is the same material as a whiteboard known in the art. The invention in this preferred embodiment becomes a portable, foldable whiteboard. It should be remembered that other types of writing surfaces are within the scope of the present invention including blackboard surfaces, electronic surfaces, automatically erasable surfaces, and any other surface that allows writing or drawing.

In FIG. 1, letters 6 can clearly be seen written on the writing surface 1. A back surface 5 as well as a horizontal center edge 2 and a vertical side edge with a protective or decorative strip 3 can be seen.

Figure 2:
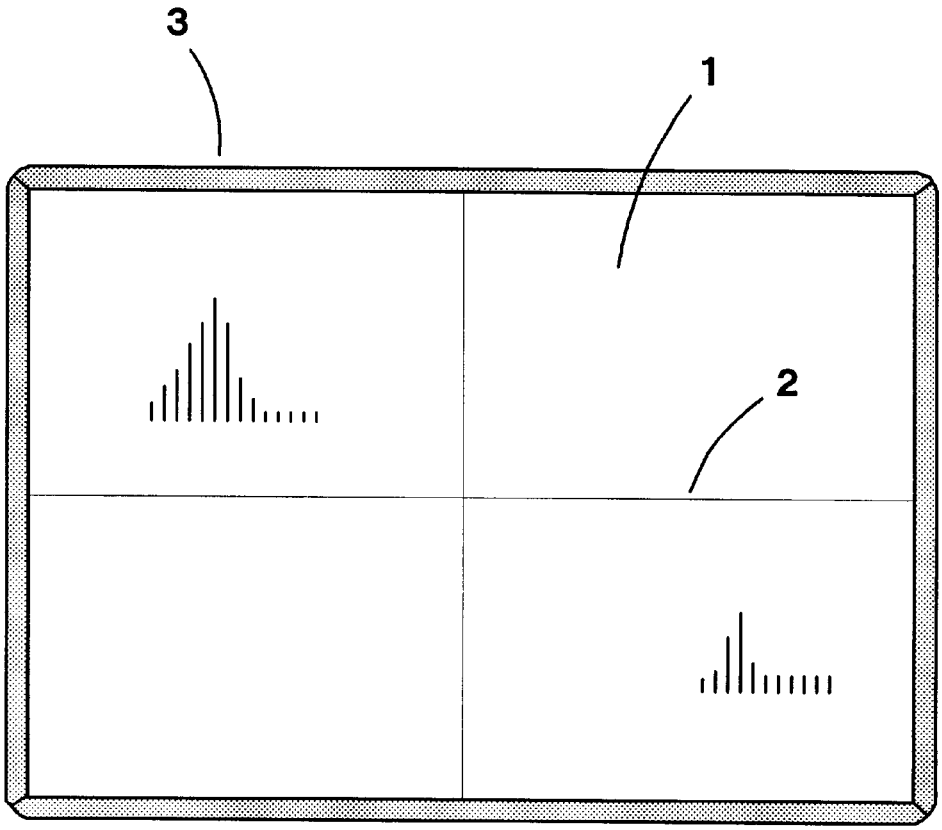
FIG. 2 shows the board laid out flat with the writing surface exposed.

FIG. 2 shows an embodiment of the present invention laid out flat so that the writing surface 1 is up. A center seam 2 can be seen running across the board. A decorative or other strip 3 can run around the outside edges.

Figure 3:
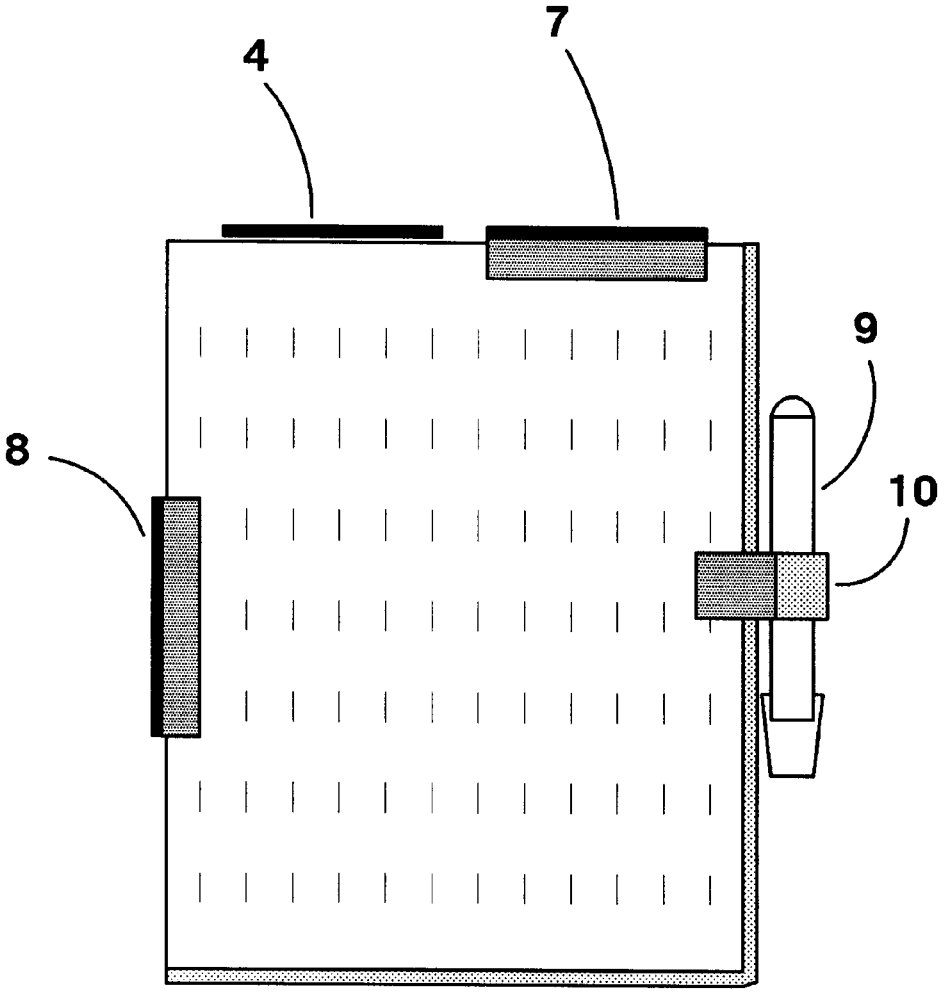
FIG. 3 shows the board folded in four with the hinges facing out.

FIG. 3 shows the present invention completely folded by four and flat—in this case with the back surface out. The present invention can be folded in two or four so that either the front writing surface 1 or the back surface 5 is out. Three hinges or attachment means are seen in FIG. 3. Two hinges 4,7 on the central seam and a third hinge 8 on the vertical seem are seen. While this figure shows the vertical hinge 8 the same length as the horizontal hinges 4,7, this is not necessary to the functioning of the invention. In fact, any length hinges or fastening means can be used. The fastening or attachment means or hinges can simply be tape, clips or other attaching devices or can be made of two elongated rigid pieces with a tape like center or bending region. The hinges or attachment means can be fibrous, plastic, metal or other material that can be constructed to fold.

FIG. 3 also shows a pen 9 which is held in place with an additional fastening means 10 which can be a strap or a hook/loop material sold under the tradename of VELCRO (VELCRO is a registered trademark). The use of hook/loop material makes removing and re-attaching the pen simpler. The pen can also optionally contain an attached eraser known in the art.

Figure 4:
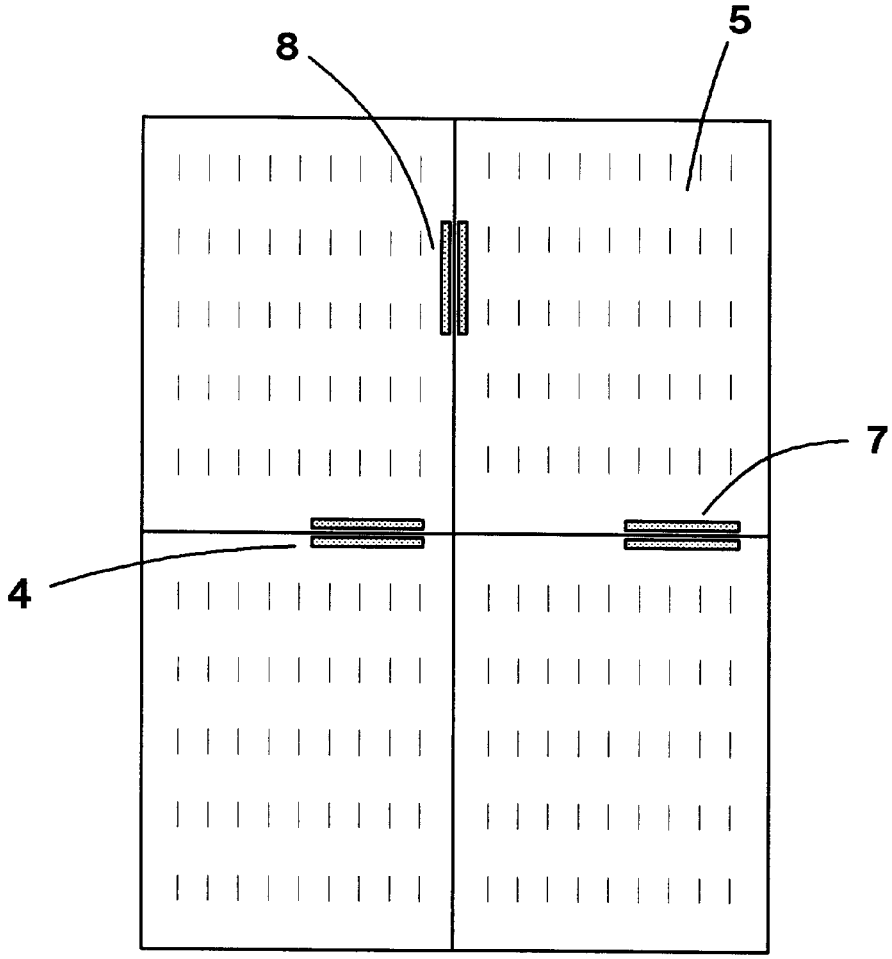
FIG. 4 shows the back side of the board with the hinges visible.

FIG. 4 shows the present invention laid out flat with the rear surface 5 exposed. Here the locations of the attaching means or hinges can be seen. The positions shown for the hinges 4, 7, 8 in FIG. 4 are optimum for folding because in these positions, the hinges do not touch each other when the board is folded in four. However, it should be noted that these hinge locations are among many that can be successfully used with the invention. In particular, the locations shown in FIG. 4 locate the horizontal hinges 4,7 about one inch from the right of their respective panels. The third hinge 8 is located on the vertical seam about 1–2 inches from the top. It should also be noted that the length of the hinges shown in FIG. 4 is about 3 inches; however, any length of hinge is within the scope of the present invention for anyone of the three.

Figure 5:
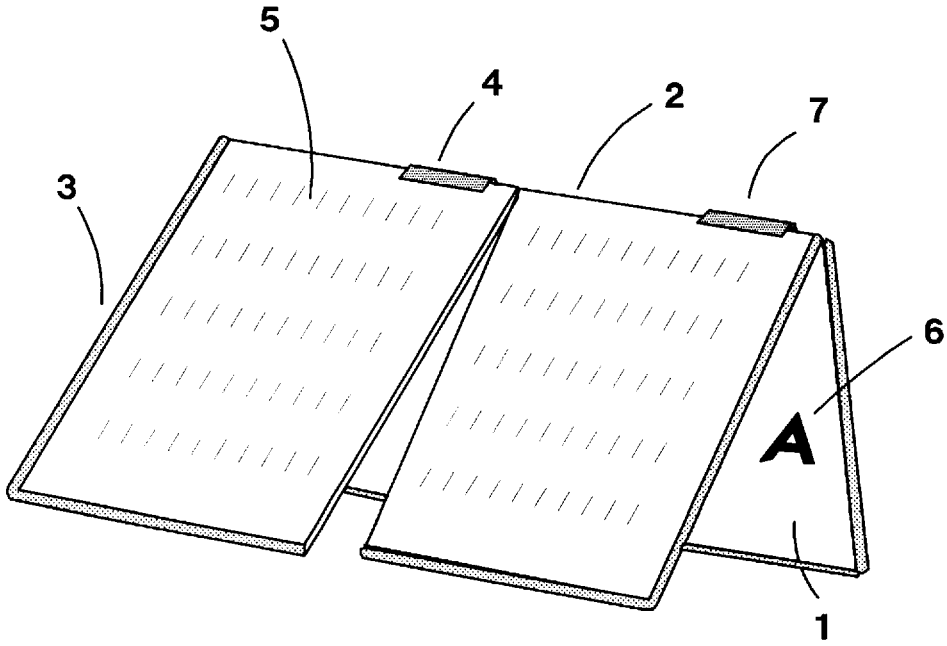
FIG. 5 shows the board folded in two with the back side out.

FIG. 5 shows the invention with the back surface 5 out being folded in two. Again the protective or decorative strip 3 can be seen running around the outer edges of the board. The writing surface 1 with writing 6 can be seen on the inside. The horizontal hinges 4,7 can be seen on the horizontal seam 2 now forming the top of the tent-like configuration.

Figure 6:
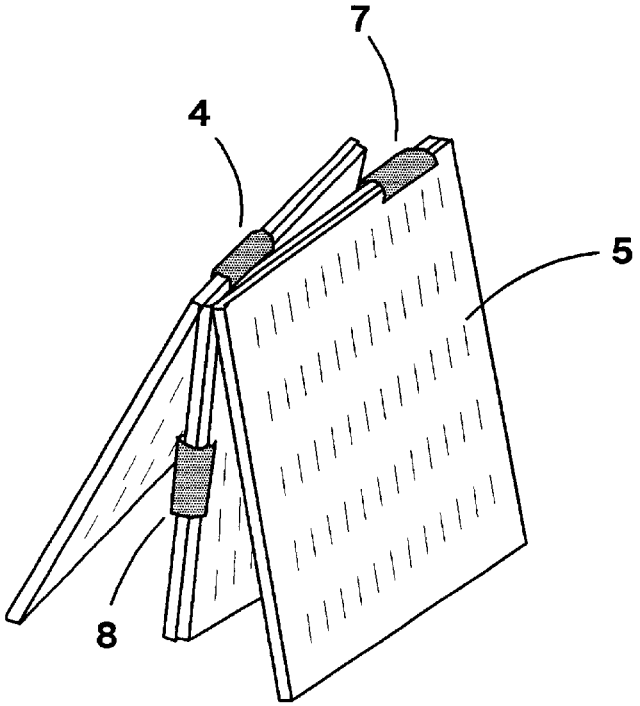
FIG. 6 shows the board partially folded in four with the back side out.

FIG. 6 shows the process of folding the present invention in four with the back surface 5 outward. The present invention can be folded either way with either the front or back surface outward. When it is folded with the back surface 5 out, maximum protection is afforded to the writing surface for example during transportation. When it is folded with the front surface 1 out, the board can be used for writing in the folded configurations. The three attachment means or hinges 4,7,8 can be seen.

Figure 7:
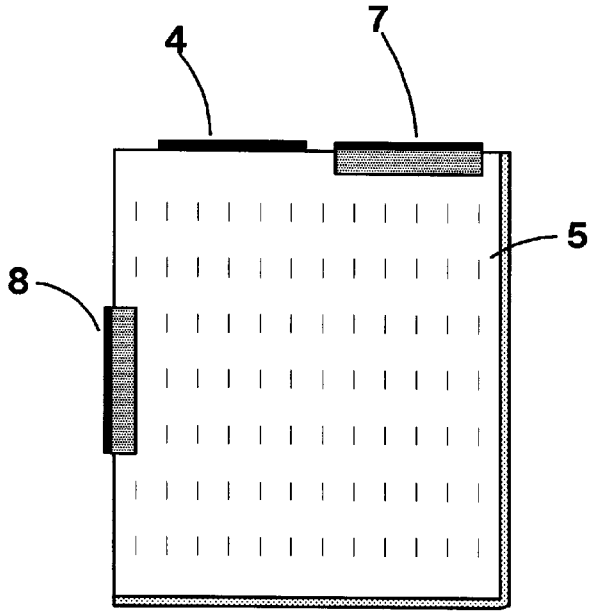
FIG. 7 shows the board completely folded in four with the back side out.

FIG. 7 shows the process of FIG. 6 carried to completion with the board completely folded flat for transportation or carrying. Again the rear surface 5 is out, but the configuration could be identical with the front surface 1 out.

Figure 9:
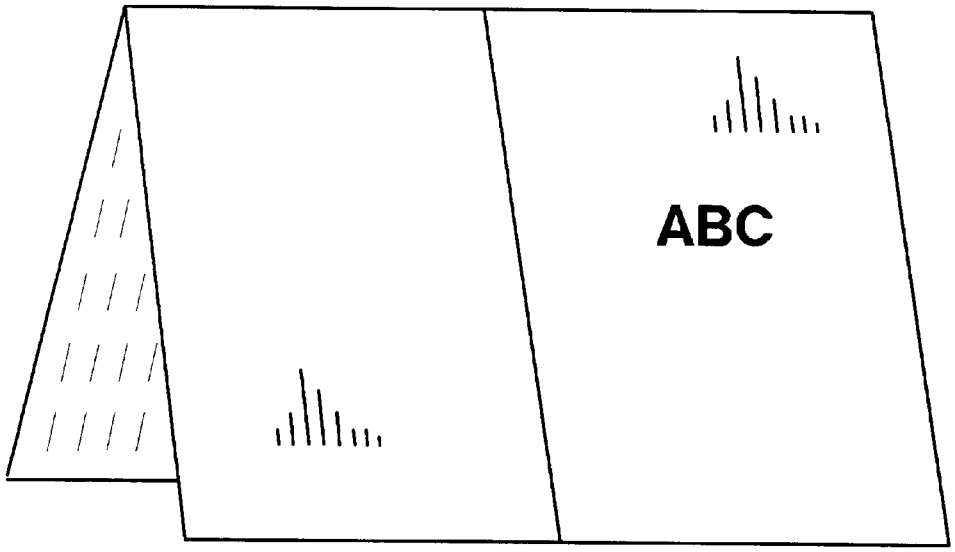
FIG. 9 shows the board folded in two with the long dimension vertical.
Figure 8:
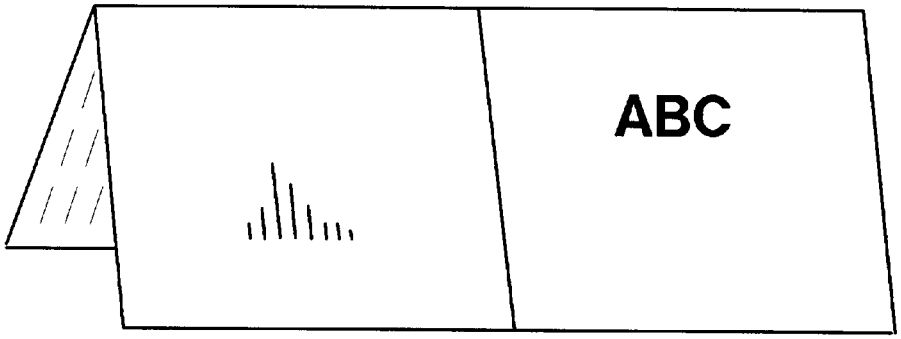
FIG. 8 shows the board folded in two with the short dimension vertical.

FIGS. 8 and 9 show the two different tent-like folded in two configurations for the invention. It should be noted that while it is preferred to have a generally rectangular shape with one edge longer than the other, it is also possible and within the scope of the present invention to use a square board. In this special case, there would only be one folded in two configuration.

Figure 10:
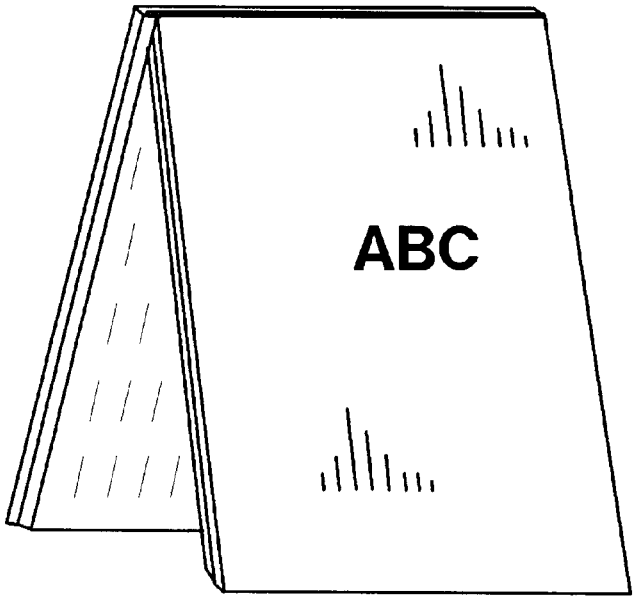
FIG. 10 shows the board folded in four with the front side out for use as a notepad.

FIG. 10 shows the present invention folded in four with the writing surface 1 out. Used in this way, the invention makes a convenient note pad, especially for use with a computer.

Figure 11:
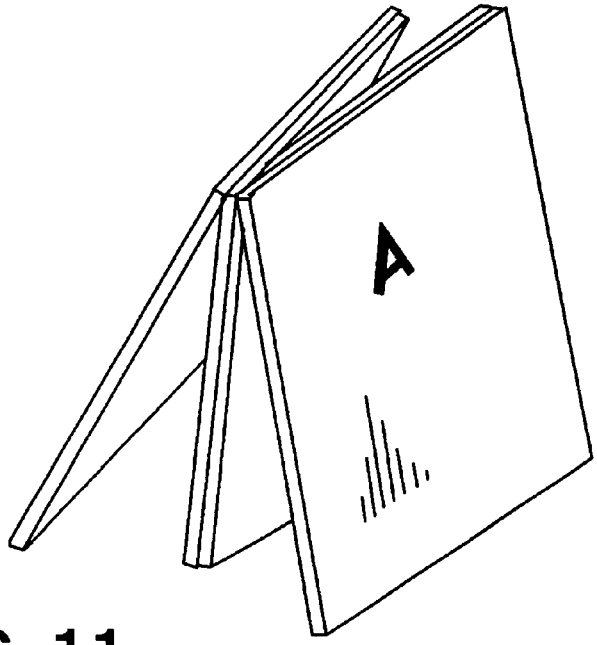
FIG. 11 shows the board completely folded in four with the front side out.

FIG. 11 shows the present invention folded flat in four with the writing surface 1 out. Here, the hinges cannot be seen, and the board can be written on flat.

It should be understood that the examples, figures, and descriptions given are for illustration only. One skilled in the art will easily recognize that many variations and many other configurations and changes could be made in which will lie within the scope of the present invention.

I claim:

1. A foldable writing board comprising:

at least 4 flat whiteboard panel means for directly writing with a felt tip pen and directly erasing with an eraser thereon, each panel means having an exposed integral writing surface and a rear surface, said exposed writing surface being directly written on with said felt tip pen and directly erased with said eraser;

said 4 panels attached to each other with hinges, said hinges holding said panels together to form a flat foldable continuous panel, said hinges allowing said panels to fold relative to each other, said panels foldable in a first folding step and a second folding step;

said first folding step causing the rear surface of each of said panels to touch the rear surface of one other of said panels forming at least two panel pairs each with an exposed writing surface facing outward;

said second folding step causing at least two writing surfaces of said panel pairs to touch one another forming a stack of said panels with at least two exposed writing surfaces facing outward.

2. The foldable writing board of claim 1 where none of said hinges touch another of said hinges during said second folding step.

3. The foldable writing board of claim 1 wherein said panels means are rectangular.

4. The foldable writing board of claim 1 further comprising a pen attached to at least one of said panel means.

5. The foldable writing board of claim 4 wherein said pen has an attached eraser.

6. A writing board device designed for portable use in a variety of writing configurations comprising four rectangular integral writing panels of whiteboard material for directly writing thereon with a felt tip pen and directly erasing thereon with an eraser, each with edges, attached to each other to form a larger rectangle when laid out flat, and attached in a way allowing the panels to fold along any adjacent edges either inward or outward so the panels can be folded along a horizontal seam and set up in a tent-like fashion with whiteboard surfaces facing outward, or folded along a vertical seam and set up in a tent-like fashion with whiteboard surfaces facing outward, or folded along both a horizontal seam and a vertical seam and either set up as a notepad with whiteboard surfaces facing outward or laid flat with the four panels stacked for storage.

7. The writing board device of claim 6 further comprising an attached pen.

8. The writing board device of claim 7 wherein said attached pen has an attached eraser.

9. The writing board device of claim 6 wherein said panels are square.

10. The writing board device of claim 6 wherein the panels are attached with hinges.

11. The writing board device of claim 10 wherein said hinges clear one another when the device is stacked.

12. A foldable writing board comprising, in combination:

a first, second, third, and fourth flat rectangular writing panel, each of said panels with a front writing surface and a rear surface, and each writing panel having two longer edges and two shorter edges, each writing panel being integral for writing directly on said writing surface and erasing directly from said writing surface with an eraser;

said first panel attached to said second panel along a shorter adjacent edge on said first panel and a shorter adjacent edge on said second panel, said first and second panels attached with a first foldable attachment means for holding said adjacent edges together;

said second panel attached to said third panel along a longer adjacent edge on said second panel and a longer adjacent edge on said third panel, said second and third panels attached with a second foldable attachment means for holding said adjacent edges together;

said third panel attached to said fourth panel along a shorter adjacent edge on said third panel and a shorter adjacent edge on said fourth panel, said third and forth panels attached with a third foldable attachment means for holding said adjacent edges together;

said four attached panels forming a larger rectangle with an exposed writing surface when laid flat, said panels foldable along each of said adjacent edges through said foldable attachment means such that at least one writing surface faces outward when said panels are folded.

13. The foldable writing board of claim 12 wherein said attachment means are on said rear surfaces of said panels.

14. The foldable writing board of claim 12 wherein said foldable attachment means are hinges.

15. The foldable writing board of claim 12 wherein said foldable attachment means are tape.

16. The foldable writing board of claim 12 wherein said rectangular writing include whiteboard material on said writing surfaces.

17. The foldable writing board of claim 12 further comprising a pen attached to at least one of the panels.

18. The foldable writing board of claim 17 wherein the pen is attached to an edge of said one of the panels.

19. The foldable writing board of claim 18 wherein said pen is attached to said panel by VELCRO.

20. The foldable writing board of claim 12 wherein said panels are around 11 inches by 8½ inches.

* * * * *